US007993114B2

(12) United States Patent
Hayashi

(10) Patent No.: US 7,993,114 B2
(45) Date of Patent: Aug. 9, 2011

(54) ELECTRIC COMPRESSOR

(75) Inventor: Yasushi Hayashi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 476 days.

(21) Appl. No.: 10/552,532

(22) PCT Filed: Apr. 12, 2005

(86) PCT No.: PCT/JP2005/007359

§ 371 (c)(1),
(2), (4) Date: Oct. 11, 2005

(87) PCT Pub. No.: WO2006/001111

PCT Pub. Date: Jan. 5, 2006

(65) Prior Publication Data

US 2006/0275157 A1 Dec. 7, 2006

(51) Int. Cl.
*F04B 39/06* (2006.01)
*F04B 39/02* (2006.01)

(52) U.S. Cl. ..... 417/368; 184/6.5

(58) Field of Classification Search ..... 417/415, 417/902, 368; 184/6.18, 6.28, 7.1, 6.5; 418/94
See application file for complete search history.

(56) References Cited

U.S. PATENT DOCUMENTS 2,130,862 A * 9/1938 Steenstrup ..... 417/372
2,996,240 A * 8/1961 Stocklein et al. ..... 417/372
3,692,435 A * 9/1972 Iida et al. ..... 417/372
3,848,702 A * 11/1974 Bergman ..... 184/6.3
4,236,879 A * 12/1980 Abe ..... 417/368
4,462,772 A * 7/1984 Hazaki et al. ..... 418/55.6
4,472,114 A * 9/1984 Fujiwara et al. ..... 417/372
4,828,466 A * 5/1989 Kim ..... 418/88
4,865,527 A * 9/1989 Piera et al. ..... 417/368
5,038,891 A * 8/1991 Wallis ..... 184/6.16
5,842,420 A * 12/1998 Khoo et al. ..... 184/6.16
5,884,727 A * 3/1999 Ryu ..... 184/6.3
5,971,724 A * 10/1999 Choi ..... 417/415
6,139,295 A * 10/2000 Utter et al. ..... 418/55.6
6,319,295 B1 * 11/2001 Tojner ..... 55/302
6,457,561 B1 * 10/2002 Goodnight ..... 184/6.16
6,637,550 B2 * 10/2003 Koyama et al. ..... 184/6.16

(Continued)

FOREIGN PATENT DOCUMENTS

GB 1 023 018 3/1966

(Continued)

OTHER PUBLICATIONS

International Search Report corresponding to International Application No. PCT/JP2005/007359 dated Apr. 12, 2005.

*Primary Examiner* — Devon C Kramer
*Assistant Examiner* — Amene S Bayou
(74) *Attorney, Agent, or Firm* — RatnerPrestia

(57) ABSTRACT

An electric compressor includes a shaft with a forward leading groove and a reverse leading groove both engraved on its outer wall. When a motor rotates forward, the forward leading groove pumps up lubricant through a centrifugal pump thereby lubricating sliding sections of the compressor. The reverse leading groove has a lead directing opposite to that of the forward leading groove, and when the motor rotates reversely due to some reason, the reverse leading groove pumps up the lubricant through the centrifugal pump thereby lubricating the sliding sections.

8 Claims, 6 Drawing Sheets

U.S. PATENT DOCUMENTS

| | | | | |
|---|---|---|---|---|
| 6,702,067 | B2 * | 3/2004 | Iversen et al. | 184/6.16 |
| 7,144,229 | B2 * | 12/2006 | Ishida et al. | 417/415 |
| 2003/0161741 | A1 * | 8/2003 | Noguchi et al. | 417/372 |
| 2004/0126250 | A1 * | 7/2004 | Tsuchiya et al. | 417/368 |
| 2005/0115771 | A1 * | 6/2005 | Shin | 184/6.16 |

FOREIGN PATENT DOCUMENTS

| | | |
|---|---|---|
| JP | 60 116885 | 10/1985 |
| JP | 62 44108 | 9/1987 |
| JP | 2000 087856 | 3/2000 |
| WO | WO 03/052271 | 6/2003 |

* cited by examiner

ELECTRIC COMPRESSOR

THIS APPLICATION IS A U.S. NATIONAL PHASE APPLICATION OF PCT INTERNATIONAL APPLICATION PCT/JP2005/007359.

TECHNICAL FIELD

The present invention relates to a lubricating mechanism of an electric compressor to be used in cooling devices such as a refrigerator.

BACKGROUND ART

In general, an electric compressor has a lubricating mechanism at its shaft, and Japanese Patent Examined Publication No. S62-44108 discloses one of those instances. FIG. 5 shows a sectional view of this conventional compressor, and FIG. 6 shows an electric connection diagram of this compressor.

In FIG. 5, hermetic container 1 accommodates electric motor 4 formed of stator 18 and rotor 8, and compressing mechanism 2. Shaft 7 extends through bearing 6 of block 3, and rotor 8 of the motor is rigidly mounted to an outer wall of shaft 7, of which eccentric shaft 9 is coupled to piston 10 by slider 11. Shaft 7 includes centrifugal pump 12 formed at its lower end and opening into lubricant 17.

Shaft 7 includes spiral groove 14, engraved on its outer wall and having a lead, for leading lubricant 17 upward when the motor rotates in a predetermined forward direction. A lower end of spiral groove 14 communicates with centrifugal pump 12, and an upper end of spiral groove 14 communicates with annular lubricant groove 16 (not shown) formed on an upper end of bearing 6.

A lower end of vertical hole 15 bored in eccentric shaft 9 communicates with the annular lubricant groove 16, and an upper end of hole 15 opens into a space of hermetic container 1.

As shown in FIG. 6, stator 18 of the motor includes main coil 19 and starting coil 20. PTC (Positive Temperature Coefficient) relay 21 is coupled to starting coil 20 in series, so that a resistance-start type of single-phase induction motor is formed.

Application of a voltage starts the motor rotating in a forward direction, and a temperature of elements of PTC relay 21 sharply rises, which accompanies a sharp increase in the resistance of the elements, so that starting coil 20 is actually cut off, and the motor is driven only by main coil 19. Lubricant 17 is sucked up to spiral groove 14 by centrifugal pump 12, and rotation of spiral groove 14 transports lubricant 17 upward for lubricating sliding sections of the compressor.

However, since the conventional electric compressor discussed above prepares the winding direction of the lead of the spiral groove 14 based on an assumption of a forward rotating direction, spiral groove 14 fails to transport the lubricant upward if the motor rotates in a reverse direction due to some reason. As a result, the sliding sections encounter no lubricant. This reverse rotation lasts until the compressor is stopped (max. several hours), and the motor returns to the forward rotation when the motor is re-started. However, abrasion sometimes occurs in the sliding sections during the reverse rotation.

DISCLOSURE OF THE INVENTION

The present invention addresses the problem discussed above, and aims to provide an electric compressor that can lubricate the sliding sections with a minimum quantity even if the motor rotates in a reverse direction.

The electric compressor of the present invention includes a shaft having a forward leading groove and a reverse leading groove both engraved on its outer wall. The forward leading groove transports lubricant upward for lubricating sliding sections when the motor rotates in a forward direction. The reverse leading groove has a lead directed oppositely to that of the forward leading groove, and transports the lubricant upward for lubricating the sliding sections when the motor rotates in a reverse direction.

DETAILED DESCRIPTION OF PREFERRED EMBODIMENT

Figure 1:
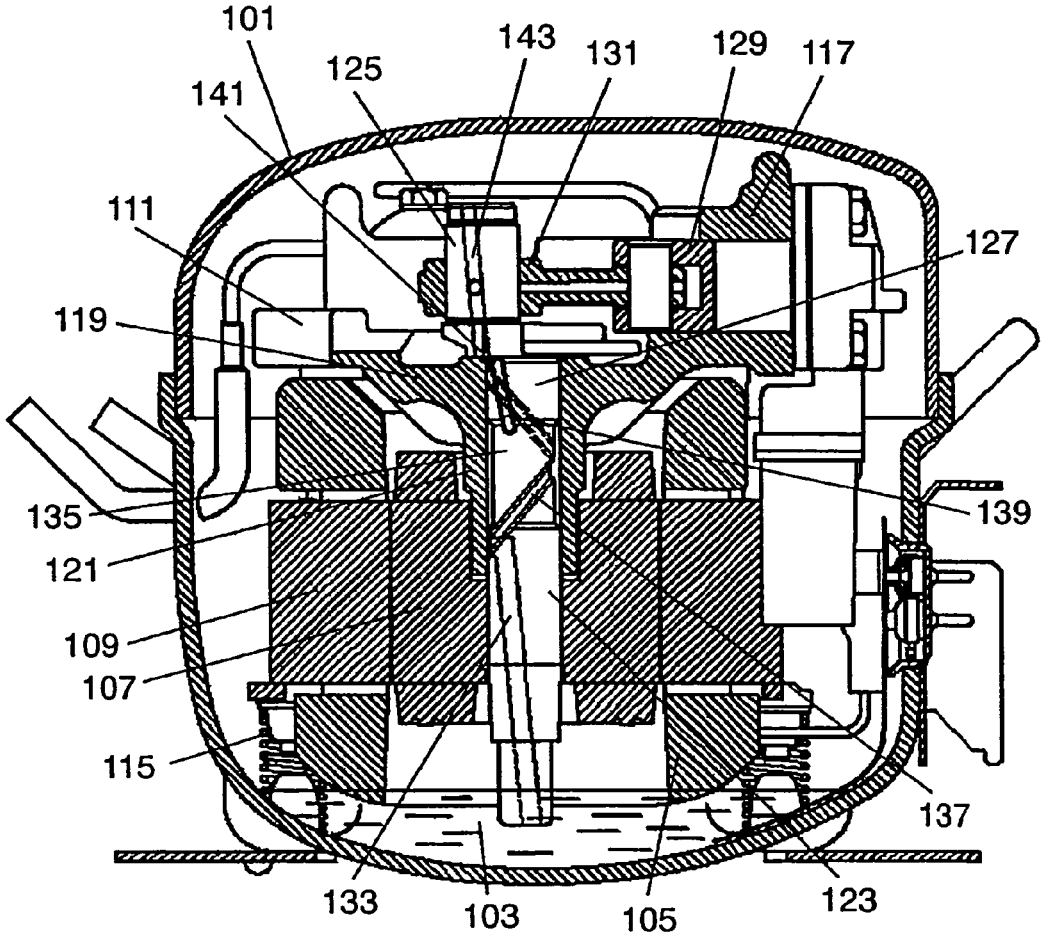
FIG. 1 is a sectional view of an electric compressor in accordance with an exemplary embodiment of the present invention.
Figure 2:
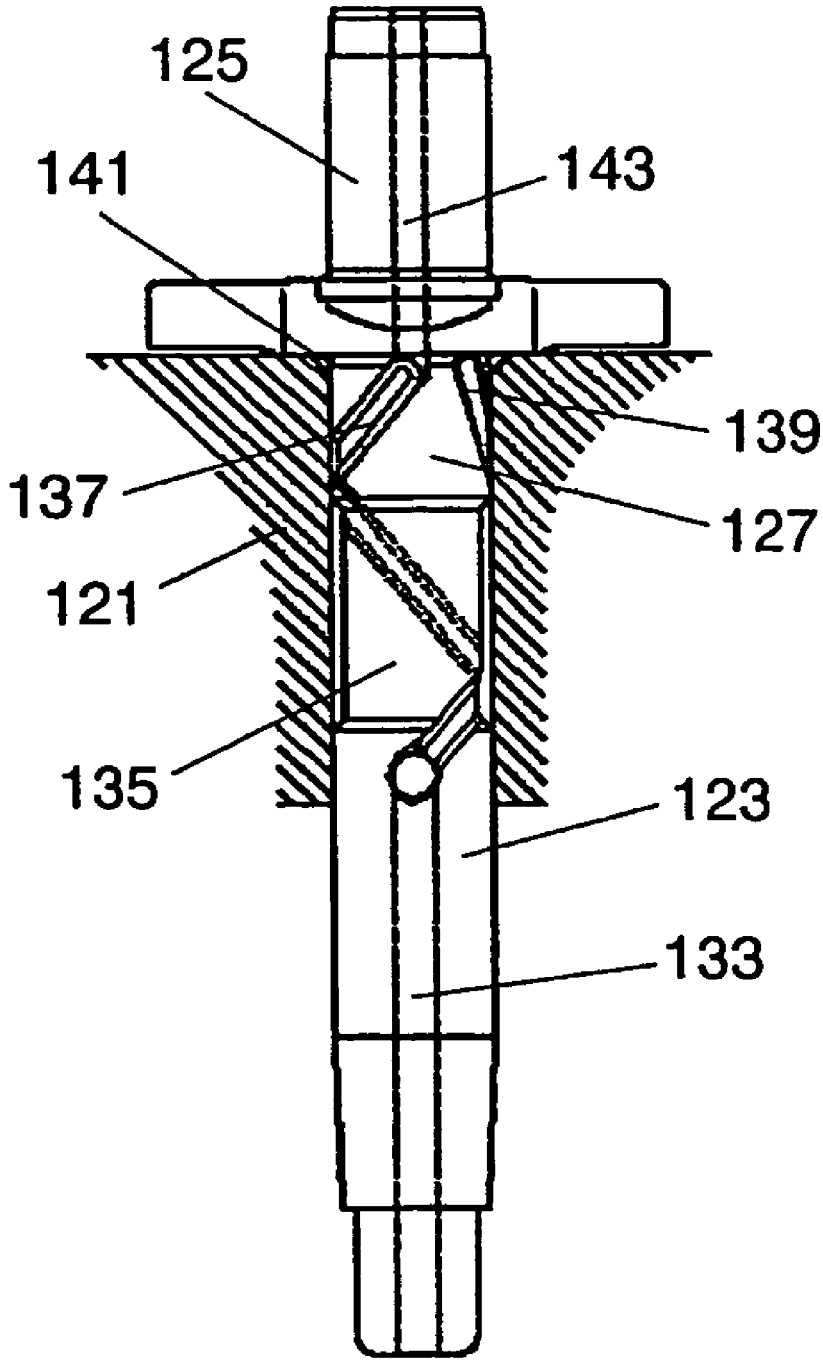
FIG. 2 is an enlarged view of a shaft of the compressor shown in FIG. 1.
Figure 3:
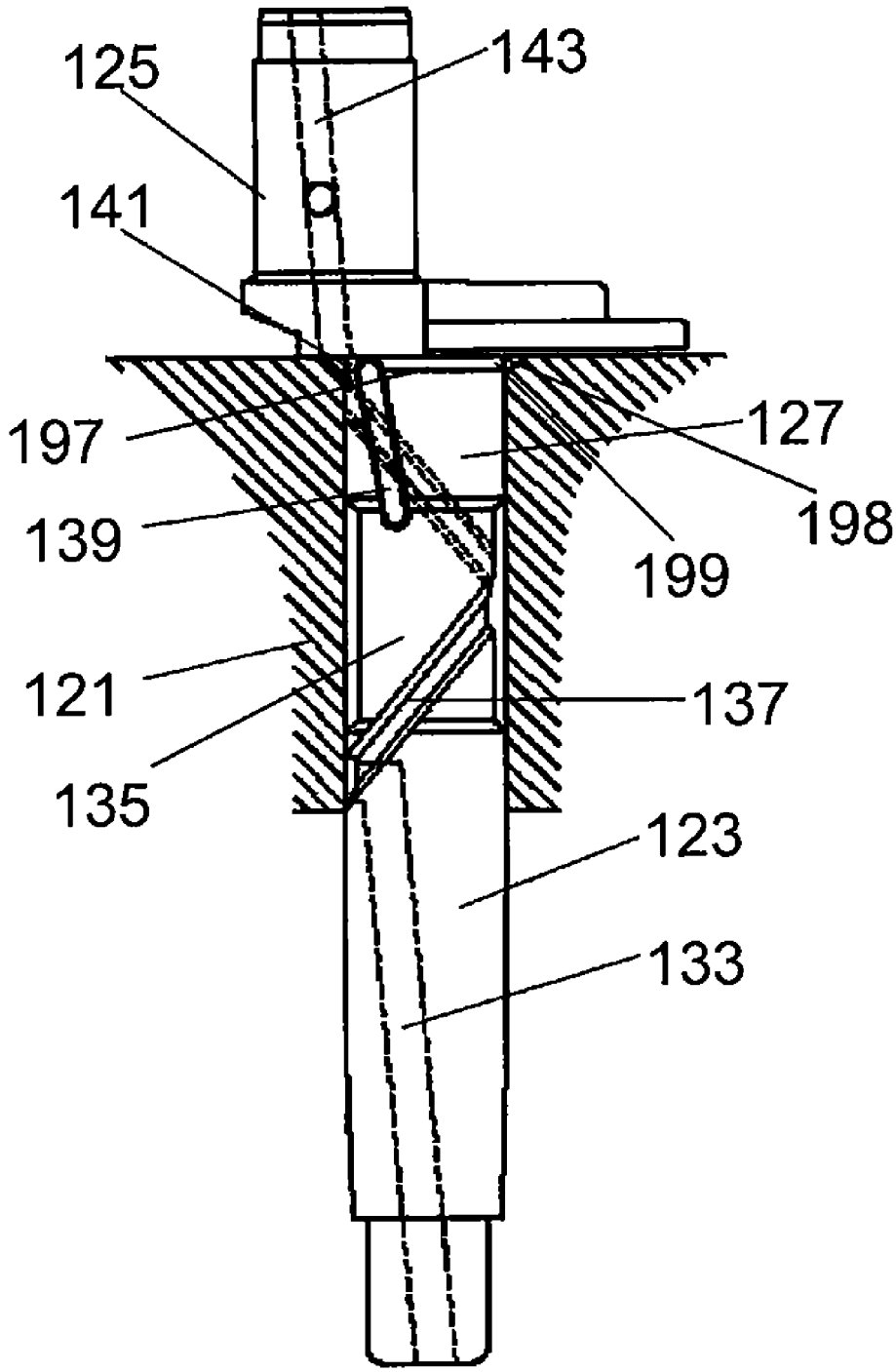
FIG. 3 is an enlarged view of a shaft of the compressor shown in FIG. 1.
Figure 4:
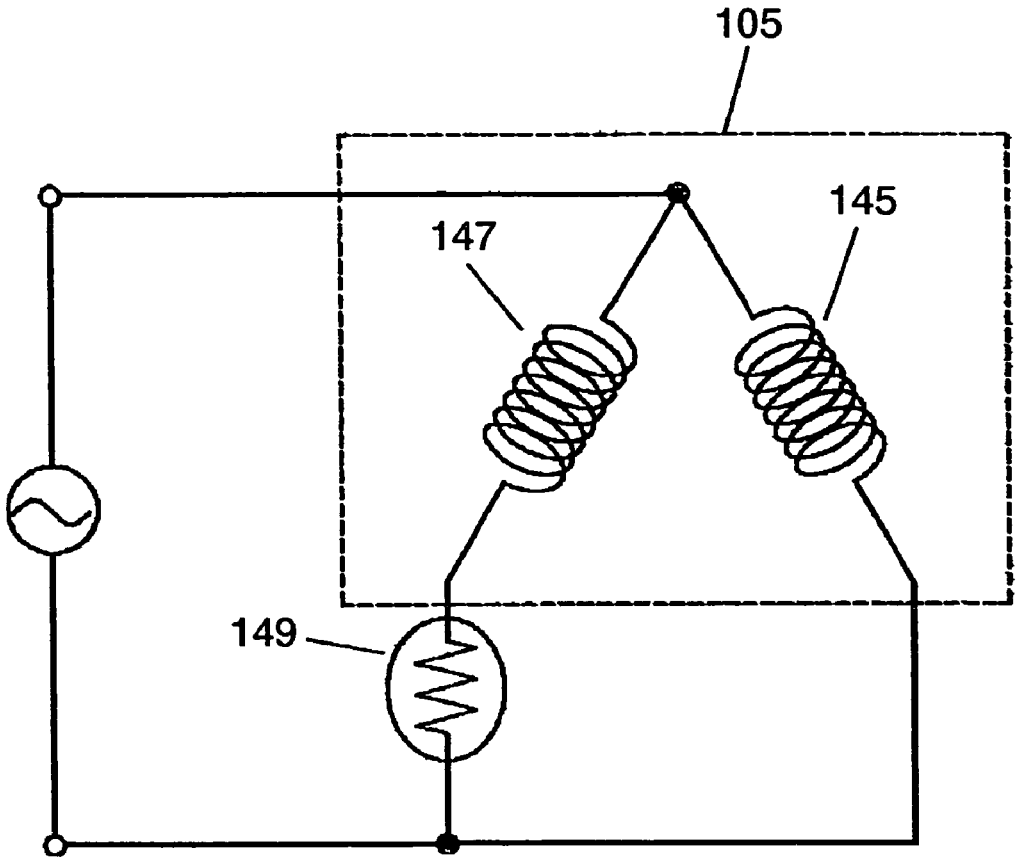
FIG. 4 is an electric connection diagram of a motor of the compressor shown in FIG. 1.
Figure 5:
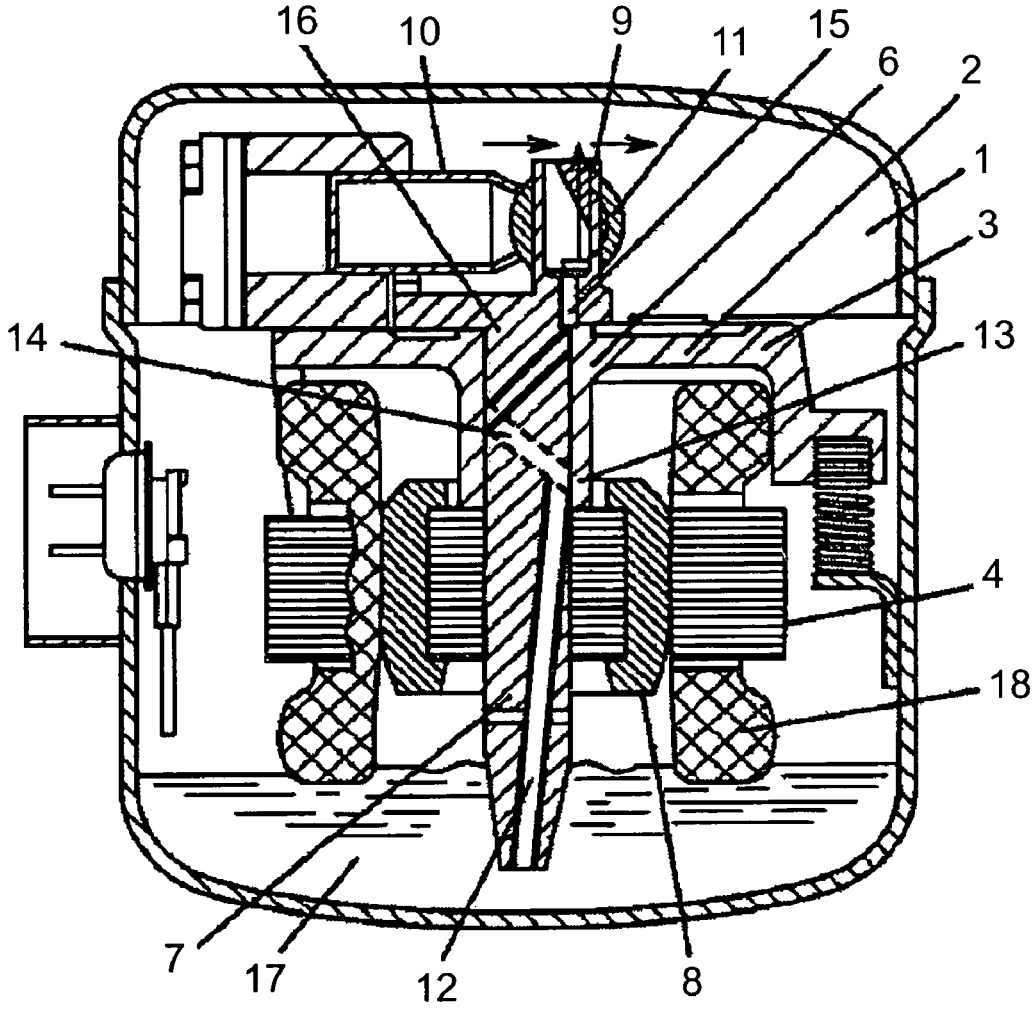
FIG. 5 PRIOR ART
FIG. 5 is a sectional view of a conventional compressor.
Figure 6:
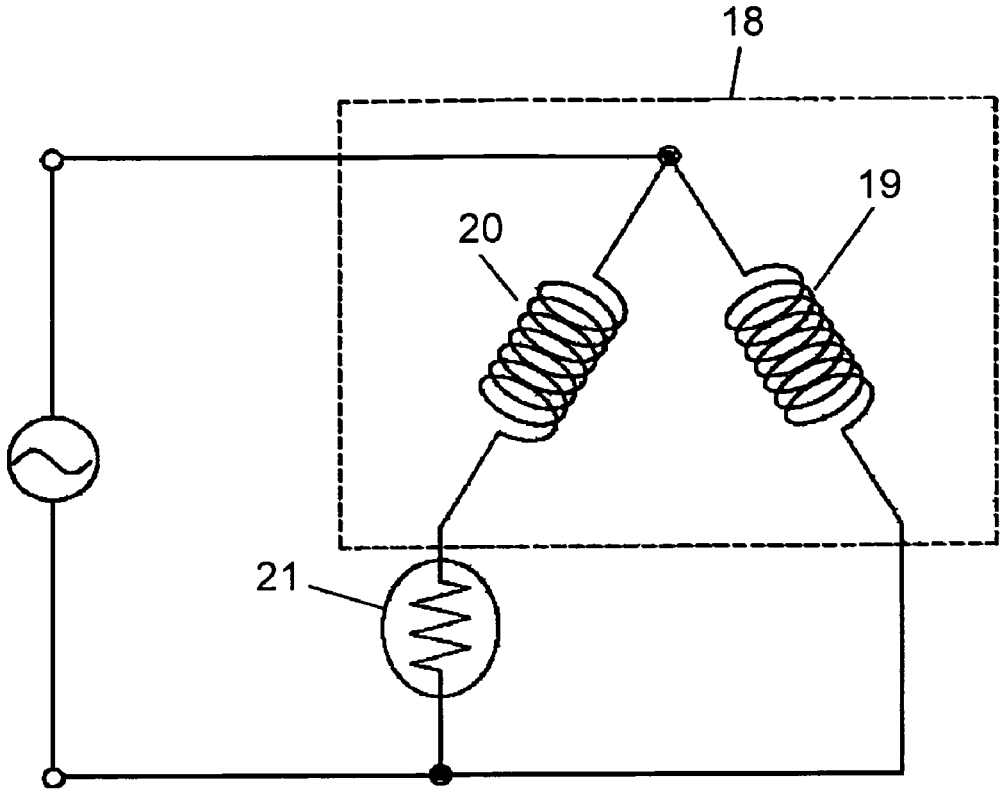
FIG. 6 PRIOR ART
FIG. 6 is an electric connection diagram of a motor of the conventional compressor.

An exemplary embodiment of the present invention is demonstrated hereinafter with reference to the accompanying drawings. FIG. 1 is a sectional view of an electric compressor in accordance with an exemplary embodiment of the present invention. FIG. 2 and FIG. 3 show enlarged views of a shaft of the compressor shown in FIG. 1. FIG. 4 is an electric connection diagram of a motor of the compressor.

In FIGS. 1, 2, and 3, lubricant 103 is pooled in hermetic container 101. Compressing mechanism 111 is disposed on an upper section of single-phase induction motor 109 that is formed of stator 105 and rotor 107. Compressing mechanism 111 is resiliently supported by spring 115 via stator 105 and accommodated in hermetic container 101.

Bearing 121 is formed in block 119. Shaft 127 having main shaft 123 and sub-shaft 125 penetrates through bearing 121, and rotor 107 is rigidly mounted to main shaft 123. Piston 129 reciprocally penetrates through cylinder 117 disposed in block 119. Sub-shaft 125 is coupled with piston 129 by connecting rod 131.

Centrifugal pump 133 is formed at a lower end of main shaft 123, and opens into lubricant 103. A thinner section 135 having a smaller diameter than that of main shaft 123 is formed at a part of main shaft 123. Forward leading groove 137 and reverse leading groove 139, having a lead directed oppositely to that of forwarding leading groove 137, are engraved on the outer wall of main shaft 123. Circumferential notch 197 is also formed in the outer wall of main shaft 123. Entire rounding section of the upper end of bearing 121 is chamfered, and annular lubricant groove 141 is formed between the chamfered section of bearing 121 and the circumferential notch 197 of main shaft 123.

A first end of forward leading groove 137 communicates with centrifugal pump 133, and a second end thereof opens directly to annular lubricant groove 141. A first end of reverse leading groove 139 communicates with centrifugal pump 133 via thinner section 135, and a second end thereof directly opens to annular lubricant groove 141. A cross sectional area of reverse leading groove 139 is smaller than that of forward leading groove 137, and the lead of reverse leading groove 139 is greater than that of forward leading groove 137.

Vertical hole 143, of which first end communicates with annular lubricant groove 141 and second end opens in hermetic container 101, is provided in sub-shaft 125. Vertical hole 143 slants with respect to the center of shaft 127 such that its upper section slants outward.

As shown in FIG. 4, stator 105 includes main coil 145 and starting coil 147. PTC relay 149 to be used for starting the motor is coupled to starting coil 147 in series.

An operation and an effort of the compressor having the structure discussed above is demonstrated hereinafter. First, an AC power supply is applied to the motor, and a current runs through main coil 145 and starting coil 147, so that rotor 107 starts rotating in a predetermined forward direction. Then PTC relay 149 increases resistance sharply at its elements, so that the current supply to starting coil 147 is cut off. As a result, rotor 107 is driven only by main coil 145 to keep rotating in the forward direction. Eccentric rotation of sub-shaft 125 via connecting rod. 131 reciprocates piston 129 in cylinder 117, so that compression work is done.

Lubricant 103 rises in centrifugal pump 133 due to centrifugal force generated by centrifugal pump 133, and is transported to a lower end of forward leading groove 137, then transported to annular lubricant groove 141 by pumping force of forward leading groove 137.

The lubricant transported in annular lubricant groove 141 is pushed to an outer rim section 198 of annular lubricant groove 141 by the centrifugal force, the outer rim 198 defined in part by the chamfered section of the bearing 121. The lubricant is then raised through vertical hole 143 communicating with the outer rim section 198 of annular lubricant groove 141, thereby lubricating sliding sections such as connecting rod 131 and piston 129. Parts of the lubricant are discharged from an upper end of vertical hole 143 into a space of hermetic container 101. Since vertical hole 143 slants as shown in FIG. 3, centrifugal force is additionally added to the lubricant, so that an amount of the lubricant increases.

At this moment, if the lubricant flows into reverse leading groove 139, the lubricant is pushed down by downward force of reverse leading groove 139; however reverse leading groove 139 opens into an inner rim 199 of annular lubricant groove 141, the inner rim defined in part by the circumferential notch 197 of the mainshaft 123. The lubricant is then pushed to the outer rim 198 of annular lubricant groove 141 by the centrifugal force, so that little amount of the lubricant flows into reverse leading groove 139.

As shown in FIG. 3, reverse leading groove 139 never crosses with forward leading groove 137, so that the lubricant is hardly pushed down by reverse leading groove 139.

Further, because reverse leading groove 139 has a cross-sectional area smaller than that of forward leading groove 137, and reverse leading groove 139 has a lead greater than that of forward leading groove 137, the down-force generated by reverse leading groove 139 is so small that lubrication similar to the prior art can be maintained when the motor rotates in the forward direction.

Next, an operation of the compressor when the motor rotates in the reverse direction is explained. When the motor once stops, it is necessary to cool the PTC relay 149 in order to lower the resistance of elements of PTC relay 149 before the power is turned on again. If the time for cooling is too short, a turning-on of the power (e.g. just after an instantaneous power failure) does not allow a current to run through starting coil 147 because the elements of PTC relay 149 still have high resistance, so that the motor fails to start. In this case, if piston 129 is pushed back by repulsion force of compressed gas, and rotates the shaft in the reverse direction, the motor starts rotating in the reverse direction.

Centrifugal pump 133 produces pumping force regardless of a rotating direction, and lubricant 103 is transported to reverse leading groove 139 via centrifugal pump 133, forward leading groove 137 and thinner section 135. The lubricant transported to reverse leading groove 139 is transported to annular lubricant groove 141 by the pumping force of reverse leading groove 139.

The lubricant transported in annular lubricant groove 141 is pushed to the outer rim of annular lubricant groove 141 by the centrifugal force, and raised into vertical hole 143 communicating with annular lubricant groove 141, thereby lubricating sliding sections such as connecting rod 131 and piston 129. Parts of the lubricant are discharged from an upper end of vertical hole 143 into a space of hermetic container 101. Since vertical hole 143 slants as shown in FIG. 3, centrifugal force is additionally added to the lubricant, so that an amount of the lubricant increases.

At this moment, if the lubricant flows into forward leading groove 137, the lubricant is pushed down by downward force of forward leading groove 137; however forward leading groove 137 opens into inner rim of annular lubricant groove 141, and the lubricant is pushed to the outer rim of annular lubricant groove 141 by the centrifugal force, so that little amount of the lubricant flows into forward leading groove 137.

As shown in FIG. 3, forward leading groove 137 never crosses with reverse leading groove 139, so that the lubricant is hardly pushed down by forward leading groove 137.

Further, since reverse leading groove 139 has the cross-sectional area smaller than that of forward leading groove 137, and reverse leading groove 139 has a lead greater than that of forward leading groove 137, the pumping force generated by reverse leading groove 139 is so small that an amount of lubricant is smaller in the reverse rotation than in the forward rotation. Experiments tell that an amount of lubricant in the reverse rotation is approx. 20% as little as that in the forward rotation; however, this amount is enough for an operation in several hours.

As discussed above, the lubricating mechanism of the present invention supplies a similar amount of lubricant to that of conventional ones when the motor rotates in the forward direction, and supplies an amount enough to an operation in several hours when the motor rotates in the reverse direction. As a result, a compressor with high reliability is obtainable.

INDUSTRIAL APPLICABILITY

The electric compressor of the present invention allows maintaining lubrication even in a reverse rotating operation, so that a highly reliable compressor is obtainable. The compressor can be used in vending machines and air-conditioners in addition to refrigerators.

REFERENCE NUMERALS IN THE DRAWINGS

101 hermetic container
103 lubricant
105 stator
107 rotor
109 single-phase induction motor
111 compressing mechanism
117 cylinder
121 bearing
123 main shaft
125 sub-shaft
127 shaft
133 centrifugal pum
135 thinner section
137 forward leading groove
139 reverse leading groove
141 annular lubricant groove
143 vertical hole

The invention claimed is:

1. Electric compressor comprising:

a single-phase induction motor comprising a stator and a rotor;

a compressing mechanism driven by the motor; and a hermetic container for accommodating the motor and the compressing mechanism and for pooling lubricant, wherein the compressing mechanism includes:

a shaft having a main shaft and a sub-shaft, the main shaft comprising a first section having a first diameter and a second section having a second diameter smaller than the first diameter;

a cylinder for forming a compressing chamber;

an annular lubricant groove having an inner rim and an outer rim; and a bearing for supporting the main shaft, the bearing defining in part the outer rim of the annular lubricant groove, wherein the shaft includes:

a circumferential notch defining in part the inner rim of the annular lubricant groove, the circumferential notch having a lower axial surface;

a centrifugal pump opening into the lubricant;

a forward leading groove engraved on an outer wall of the main shaft, the forward leading groove extending to and opening at the lower axial surface of the circumferential notch, and the forward leading groove having a first end communicating with the centrifugal pump and a second end opening to the inner rim of the annular lubricant groove;

a reverse leading groove having a lead directing in an opposite direction to that of the forward leading groove, the reverse leading groove extending to and opening at the lower axial surface of the circumferential notch, and the reverse leading groove having a first end communicating with the centrifugal pump via the second section of the shaft, and a second end opening to the inner rim of the annular lubricant groove; and a vertical hole bored in the sub-shaft and having a first end communicating with the outer rim of the annular lubricant groove, and a second end opening into the hermetic container, wherein the forward leading groove, the annular lubricant groove, and the vertical hole define a lubricant pathway such that (1) the lubricant passes from the forward leading groove to the annular lubricant groove, and (2) the lubricant passes from the annular lubricant groove to the vertical hole, and wherein the reverse leading groove has at least one of (1) a cross-sectional area smaller than that of the forward leading groove and (2) a lead greater than that of the forward leading groove.

2. The electric compressor of claim 1, wherein the reverse leading groove is formed at an intermediate section of the shaft.

3. The electric compressor of claim 1, wherein the vertical hole slants with respect to a shaft center of the main shaft such that an upper section of the vertical hole slants outward.

4. The electric compressor of claim 1, wherein an entire rounding section of the upper end of the bearing is chamfered and the annular lubricant groove is formed between the chamfered section and the main shaft.

5. The electric compressor of claim 1, wherein an angle of the reverse leading groove with respect to a plane perpendicular to an axis of the main shaft is larger than an angle of the forward leading groove with respect to the plane perpendicular to the axis of the main shaft.

6. The electric compressor of claim 1, wherein the reverse leading groove, the annular lubricant groove, and the vertical hole define a lubricant pathway such that (1) the lubricant passes from the reverse leading groove to the annular lubricant groove, and (2) the lubricant passes from the annular lubricant groove to the vertical hole.

7. Electric compressor comprising:

a single-phase induction motor comprising a stator and a rotor;

a compressing mechanism driven by the motor; and a hermetic container for accommodating the motor and the compressing mechanism and for pooling lubricant, wherein the compressing mechanism includes:

a shaft having a main shaft and a sub-shaft, the main shaft comprising a first section having a first diameter and a second section having a second diameter smaller than the first diameter;

a cylinder for forming a compressing chamber;

an annular lubricant groove having an inner rim and an outer rim; and a bearing for supporting the main shaft, the bearing defining in part the outer rim of the annular lubricant groove, wherein the shaft includes:

a circumferential notch defining in part the inner rim of the annular lubricant groove, the circumferential notch having a lower axial surface;

a centrifugal pump opening into the lubricant;

a forward leading groove engraved on an outer wall of the main shaft, the forward leading groove extending to and opening at the lower axial surface of the circumferential notch, and the forward leading groove having a first end communicating with the centrifugal pump and a second end opening to the inner rim of the annular lubricant groove;

a reverse leading groove having a lead directing in an opposite direction to that of the forward leading groove, the reverse leading groove extending to and opening at the lower axial surface of the circumferential notch, and the reverse leading groove having a first end communicating with the centrifugal pump via the second section of the shaft, and a second end opening to the inner rim of the annular lubricant groove; and a vertical hole bored in the sub-shaft and having a first end communicating with the outer rim of the annular lubricant groove, and a second end opening into the hermetic container, wherein the reverse leading groove opens into the inner rim of the annular lubricant groove to limit the flow of lubricant into the reverse leading groove when the motor rotates in a predetermined forward direction, the reverse leading groove including at least one of (1) a cross-sectional area smaller than a cross-sectional area of the forward leading groove and (2) a lead greater than a lead of the forward leading groove.

8. The electric compressor of claim 7, wherein the forward leading groove opens into the inner rim of the annular lubricant groove to limit the flow of lubricant into the forward leading groove when the motor rotates in a reverse direction.

* * * * *

UNITED STATES PATENT AND TRADEMARK OFFICE

CERTIFICATE OF CORRECTION

PATENT NO. : 7,993,114 B2
APPLICATION NO. : 10/552532
DATED : August 9, 2011
INVENTOR(S) : Yasushi Hayashi It is certified that error appears in the above-identified patent and that said Letters Patent is hereby corrected as shown below:

On the Cover page, insert the following:
item -- (30) Foreign Application Priority Data June 28, 2004 (JP) 2004-189190 --

Signed and Sealed this
Twenty-second Day of November, 2011

David J. Kappos

David J. Kappos
*Director of the United States Patent and Trademark Office*